United States Patent [19]

Hay et al.

[11] 4,307,882

[45] Dec. 29, 1981

[54] BALL GAME FOR INDOOR USE

[76] Inventors: Eric I. Hay, Byälvsvägen 41, S-121 74 Johanneshov; Anders S. W. Nordström, Träsnittsvägen 18, S-196 32 Kungsängen, both of Sweden

[21] Appl. No.: 34,588

[22] Filed: Apr. 30, 1979

[30] Foreign Application Priority Data

May 2, 1978 [SE] Sweden ..... 7805039

[51] Int. Cl.[3] ..... A63B 67/04

[52] U.S. Cl. ..... 273/30; 273/67 R; 273/411

[58] Field of Search ..... 273/30, 85 R, 76, 61 A, 273/119 R, 80.2, 167 D

[56] References Cited

U.S. PATENT DOCUMENTS

| | | | |
|---|---|---|---|
| D. 202,715 | 11/1965 | Solkeim | 273/167 D |
| 829,947 | 9/1906 | Carter | 273/85 R |
| 1,222,901 | 10/1919 | Dunlop | 273/61 A |
| 2,688,484 | 9/1954 | Garber | 273/30 |
| 3,228,688 | 1/1966 | Dennison | 273/85 R |
| 3,468,536 | 9/1969 | Menshull et al. | 273/30 |
| 3,477,717 | 11/1969 | Clark | 273/30 |

FOREIGN PATENT DOCUMENTS

| | | | |
|---|---|---|---|
| 784191 | 7/1935 | France | 273/30 |
| 203516 | 9/1923 | United Kingdom | 273/30 |

*Primary Examiner*—Richard C. Pinkham
*Assistant Examiner*—T. Brown
*Attorney, Agent, or Firm*—Saidman & Sterne

[57] ABSTRACT

A ball game for indoor use comprising a playing surface or a court, a netting, rackets or bats, and a ball. The length of the court is between 1.5 feet and 6.5 feet. Each racket has a handle arranged at an angle with respect to the striking face of the racket. The edge portion of the striking face of the racket is provided with a sliding surface designed to contact the court during the game. The diameter of the ball is between $\frac{3}{8}''$ and $1\frac{1}{4}''$, and the weight of the ball is between 0.0035 and 0.0180 oz.

2 Claims, 2 Drawing Figures

BALL GAME FOR INDOOR USE

BACKGROUND OF THE INVENTION

1. Field of the Invention

This invention relates to a ball game comprising a playing surface or a court, a netting, rackets or bats, and a ball. More particularly, this invention relates to a ball gam for indoor use which is in some respects similar to table tennis.

2. Description of the Prior Art

Table tennis was originally intended to be a parlor game to be played in furnished rooms. However, techniques of playing table tennis have greatly improved during recent decades, which in turn has resulted in a very fast game requiring considerable space. The space required for playing table tennis is often hard to find in ordinary homes.

Apart from the improved techniques of playing table tennis, the apparatus used still consists of the same kind of rackets, playing surface and balls that have been used for several decades. In U.S. Pat. No. 2,147,110 to Schmid, issued Feb. 14, 1939, an improved racket or bat for table tennis is suggested. However, this racket has not been accepted by the players. A racket according to this patent has an angularly or otherwise displaced handle in such a way that the longitudinal axis through the striking face of the racket passes substantially through the point about which the wrist of the user pivots. Such a provision of the handle gives the racket better balance in the hands of the user, so that it may be quickly controlled and moved from various positions, particularly in changing from the forehand to the backhand, and vice versa. The racket according to this Patent has no relationship to the racket according to the present invention, since the use and handling of the known racket can be substantially distinguished from the use and handling of the racket according to the present invention.

OBJECTS OF THE INVENTION

It is a primary object of this invention to provide a new and improved ball game requiring a small space only which can therefore be played in ordinary homes. It is a further object of this invention to provide a new and improved ball game which can be played by almost any person and yet gives a certain amount of enjoyment and entertainment irrespective of the degree of skillfulness of the player.

Yet another object of this invention is to provide a new and useful racket or bat to be used in practicing the ball game mentioned above.

Additional objects and advantages of the invention in part will be set forth in the description which follows and in part will be obvious from the description or may be learned by practicing of the invention. The objects and advantages of the invention may be realized and obtained by means of instrumentalities and combinations particularly pointed out in the appended claims.

SUMMARY OF THE INVENTION

To achieve the foregoing objects and in accordance with the purpose of the invention, as embodied and broadly described herein, the ball game of this invention comprises a court or a playing surface between 1.5 feet and 6.5 feet in length, a netting across the middle of the court, rackets or bats with handles arranged at an angle with respect to the striking surface of the racket, a sliding surface at the edge portion of the striking face of the racket, and a ball having a diameter between $\frac{3}{8}''$ and $1\frac{1}{4}''$ and a weight of 0.0035–0.0180 oz. Preferably the ball game uses a ball with a diameter of 13/16" and a weight of 0.0042 oz.

The racket or bat used in practicing the ball game according to the invention preferably comprises a handle arranged at an angle between 0° and 60° with respect to the perpendicular of the striking surface of the racket.

The racket preferably has a striking surface with a circular edge portion at one end thereof arranged to contact the court during playing of the ball game according to the invention.

BRIEF DESCRIPTION OF THE DRAWINGS

The accompanying drawings which are incorporated in and constitute a part of this specification, illustrate an embodiment of the invention and, together with the description, serve to explain the principles of the invention.

In the drawings.

DETAILED DESCRIPTION OF THE PREFERRED EMBODIMENT

Reference will now be made in detail to the present preferred embodiment of the invention, which is illustrated in the accompanying drawings.

Figure 1:
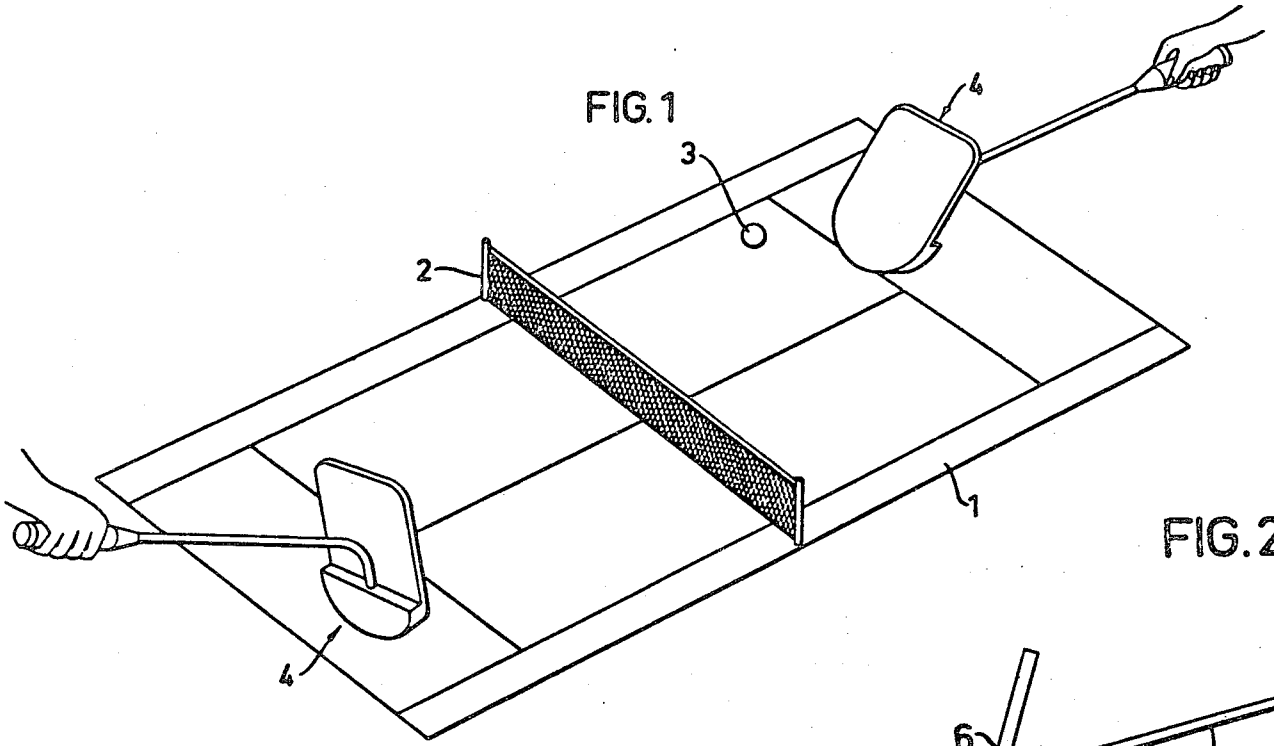
FIG. 1 is a perspective view of the ball game according to the invention showing the court or playing surface, the netting, the rackets or bats, and the ball.
Figure 2:
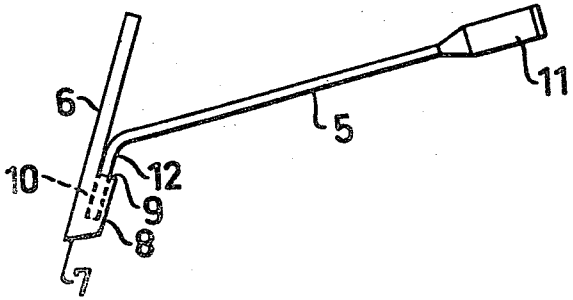
FIG. 2 is a side view of a racket forming part of the ball game according to the invention.

Referring now to FIG. 1 there is illustrated a preferred embodiment of the ball game according to the teachings of the invention wherein a playing surface 1 has the configuration of a lawn tennis court which is divided into two parts by a netting 2. The playing surface 1 may be an integral or a divided board placed on a table. The rackets 4 are shown in a side view in FIG. 2. The racket 4 comprises a striking face 6 and a shaft 5 ending in a handle 11. The striking face 6 has a substantially rectangular configuration with a rounded lower portion 7 forming a gliding surface over the court 1. The lower part 8 of the striking face 6 of the racket 4 is preferably thicker than the rest of the striking face of the racket and comprises a shelf portion 9 in which an aperture 10 is arranged parallel with the center line of the striking face of the racket. The aperture 10 in the shelf portion 9 receives a curved end portion 12 of the shaft 5. This end portion 12 may be secured in the aperture 10, thus giving the racket 4 the configuration shown in FIG. 2. The handle 11 is arranged at the free end of the shaft 5 and provides a safe grip around the shaft 5 of the racket. The ball game according to the present invention is practiced when two players with rackets 4 are playing a ball 3 above the netting 2. By pushing the racket across the court 1 towards the netting 2, the ball will hopefully be hit above the netting to the other player who tries to return the ball over the netting on a volley or after the ball strikes the court 1.

The similarities to lawn tennis, table tennis or even badminton (using a higher netting and a greater inclination between the striking face of the racket and the court) is surprising. This effect is achieved by the influence of the air resistance on the ball 3. The ball cannot cause any damage indoors no matter how hard the ball hits, which makes the ball game according to the invention very suitable for use in furnished rooms.

By using balls of different diameters and weights for courts of different lengths, the ball game according to the present invention can be provided in different embodiments which all require the same degree of concentration and ability to react. In other words, different embodiments of the ball game according to the invention can be practiced while preserving enjoyment and entertainment.

It will be apparent to those skilled in the art that various other modifications and variations in addition to those mentioned above could be made in the ball game of the invention without departing from the scope and spirit of the invention.

We claim:

1. A ball game for indoor use, comprising: a court including a playing surface between $1\frac{1}{2}$ and $6\frac{1}{2}$ feet in length, a netting across the middle of said court, a pair of rackets each having a striking face and a handle connected to said face and arranged at an angle between 0° and 60° with respect to a perpendicular to said striking face, a curved sliding surface positioned at the lower portion of said striking face, said curved sliding surface adapted to contact and slide upon said playing surface during playing of said game, and a ball having a diameter between $\frac{3}{8}''$ and $1\frac{1}{4}''$ and a weight between 0.0035–0.0180 oz.

2. A ball game as claimed in claim 1 in which the diameter of said ball is 13/16" and the weight of said ball is 0.0042 oz.

* * * * *